US005660213A

United States Patent [19]

Tholander et al.

[11] Patent Number: 5,660,213

[45] Date of Patent: Aug. 26, 1997

[54] WEFT YARN INSERTION SYSTEM HAVING DEACTIVATABLE SLIP CONVEYOR AND ASSOCIATED YARN BRAKE

[75] Inventors: Lars Helge Gottfrid Tholander, Ulricehamn; Paer Josefsson, Borås, both of Sweden

[73] Assignee: IRO AB, Ulricehamn, Sweden

[21] Appl. No.: 586,843

[22] PCT Filed: Jul. 6, 1994

[86] PCT No.: PCT/EP94/02208

§ 371 Date: Apr. 23, 1996

§ 102(e) Date: Apr. 23, 1996

[87] PCT Pub. No.: WO95/03442

PCT Pub. Date: Feb. 2, 1995

[30] Foreign Application Priority Data

Jul. 19, 1993 [DE] Germany ..... 43 24 160.3

[51] Int. Cl.[6] ..... D03D 47/30; D03D 47/34

[52] U.S. Cl. ..... 139/452; 139/450; 242/47.01

[58] Field of Search ..... 139/194, 452, 139/450; 242/47.01, 47.08, 47.09

[56] References Cited

U.S. PATENT DOCUMENTS

| | | | |
|---|---|---|---|
| 4,875,506 | 10/1989 | Gacsay et al. | 139/450 |
| 4,953,597 | 9/1990 | Van Bogaert et al. | 139/452 |
| 5,123,455 | 6/1992 | Maina | 139/452 |
| 5,141,170 | 8/1992 | Sarfati | 242/47.08 |
| 5,154,209 | 10/1992 | Takegawa | 139/452 |
| 5,190,231 | 3/1993 | Sarfati | 139/452 |
| 5,417,251 | 5/1995 | Josefsson et al. | 139/194 |

FOREIGN PATENT DOCUMENTS

| | | |
|---|---|---|
| 0 387 546 | 9/1990 | European Pat. Off. . |
| 0 464 378 | 1/1992 | European Pat. Off. . |
| 0 477 877 | 4/1992 | European Pat. Off. . |
| 37 14 826 | 6/1988 | Germany . |
| 42 10 377 | 8/1993 | Germany . |
| 42 40 710 | 6/1994 | Germany . |
| WO90/07600 | 7/1990 | WIPO . |

*Primary Examiner*—Andy Falik

*Attorney, Agent, or Firm*—Flynn, Thiel, Boutell & Tanis, P.C.

[57] ABSTRACT

An insertion system for the weft yarn of a jet loom, comprising a jet insertion device in the jet loom for withdrawing the weft yarn and for transporting the same into a shed, and a weft-yarn storage, supply and measuring device arranged upstream of the jet insertion device. The weft-yarn storage, supply and measuring device including a weft-yarn stopping and releasing device which is controllable in response to a weaving cycle. The insertion system also includes a mechanical weft-yarn slip conveyor arranged in the yarn path of the weft-yarn stopping and releasing device relative to the jet insertion device, which comprises at least on conveyor roller rotating in the insertion direction of the weft yarn at a faster circumferential speed than the maximum weft-yarn insertion speed and can be deactivated while the conveyor roller is rotating during the insertion process. With the slip conveyor activated, the weft yarn surrounds at least a partial region of the circumferential surface of the roller and can be acted upon with a slip conveyor force determined by the withdrawal tension in the weft yarn. The insertion system further includes a yarn brake arranged in the yarn path at the slip conveyor or downstream of the slip conveyor, which can be engaged in response to the weaving cycle.

20 Claims, 1 Drawing Sheet

WEFT YARN INSERTION SYSTEM HAVING DEACTIVATABLE SLIP CONVEYOR AND ASSOCIATED YARN BRAKE

FIELD OF THE INVENTION

The present invention relates to an insertion system of a jet loom.

BACKGROUND OF THE RELATED ART

In an insertion system known from EP-A1-04 77 877, a positive feed mechanism is provided downstream of a measuring feeder comprising an engageable stopper in the yarn path towards the jet insertion device of the jet loom. The feed mechanism consists either of a pair of conveyor rollers with a stationary drivable conveyor roller and a freewheeling roller and a counter-roller which can be pressed against the driven conveyor roller during part of an insertion process, or of a stationarily supported drivable conveyor roller and an actuator which presses the weft yarn onto the conveyor roller only for some time of an insertion process. The weft yarn is positively supplied for the time of the insertion process, during which the drive is activated, exactly with the speed profile of the drive and exactly at the respective circumferential speed of the conveyor roller to the jet insertion device. The drive of the driven conveyor roller is controlled according to a predetermined speed profile to relieve the jet insertion device upon withdrawal of the weft yarn. The control of the conveyor roller drive is complicated. It is difficult to adapt the engagement of the positive supply mechanism to the insertion process and to the engagement and disengagement of the stopper.

In a friction-type yarn feed device which is known from EP-B1-03 87 546 and, for instance, used for a water or air jet loom, there are provided at least two spaced-apart drums which are partly surrounded by the weft yarn and have arranged thereinbetween partition walls offset on the lateral drum surfaces. A yarn brake which is independent of the weaving cycle and fixedly set is respectively provided upstream and downstream of the friction-type yarn feed device. The friction-type yarn feed device withdraws the weft yarn from a yarn coil and supplies it with a slip to the jet loom as soon as the tension produced in the jet loom and prevailing in the weft yarn overcomes the braking effect of the yarn brake arranged downstream of the friction and yarn feed device.

It is the object of the present invention to reduce the number of yarn breaks caused by extreme changes in tension in the weft yarn during operation of a jet loom and to decrease the amount of energy spent on the medium transporting the weft yarn into the shed and to increase the insertion rate without any risk of yarn breaks.

This object is achieved with the insertion system wherein a yarn brake is provided with a slip conveyor downstream of a measuring feeder or device and a yarn brake allows the slip conveyor to be deactivated.

SUMMARY OF THE INVENTION

An exact dimensioning of the weft yarn length takes place in the weft-yarn storage, supply and measuring device. The tension produced by the jet insertion device in the weft yarn is used for requesting the slip conveyor force which supports withdrawal and acceleration and relieves the jet insertion device. The slip conveyor is not of the positively working type, but works with a slip depending, inter alia, on the weft-yarn tension, which is gentle on the weft yarn. The energy consumed by the jet insertion device can be reduced considerably to produce a specific insertion rate. Since the slip conveyor and the jet insertion device share the job, the weft yarn is gently treated. The number of yarn breaks are reduced considerably because the slip conveyor has a compensating effect and because the slip conveyor force is built up gently. The insertion rate can even be increased considerably because of job sharing, i.e., an increased insertion rate can be implemented without any risk for the weft yarn. As soon as the mass of the inserted weft yarn has to be delayed towards the end of the insertion process because of the engagement of the weft-yarn stopping and releasing device, with the jet insertion device possibly still pulling on the weft yarn, the slip conveyor force would considerably increase the yarn tension between the slip conveyor and the weft-yarn stopping and releasing device and damage or tear the weft yarn. Thanks to the deactivation of the slip conveyor, which is performed in response to the weaving cycle, the weft yarn can be stopped gently after the slip conveyor force has been decreased. A treatment of the weft yarn that is favorable with respect to yarn breaks results from the cooperation of the weft-yarn stopping and releasing device, of the slip conveyor which can be deactivated despite the rotating conveyor roller, of the engageable yarn brake and the jet insertion device, i.e. despite the possibility of an increased insertion rate at a decreased amount of energy spent on the jet insertion device. The action of the slip conveyor which is disadvantageous for the weft yarn with the slip conveyor working in response to yarn tension is not felt due to the deactivation thereof at the insertion end. The insertion system is of a simple construction and easy to control because the slip conveyor force is solely built up and reduced on the basis of cooperating components of the insertion system and does not require a control of its own.

Although it is known that a slip conveyor is arranged upstream of a measuring feeder in the yarn path, the slip conveyor has no influence on the insertion rate, the yarn breaks downstream of the measuring feeder and the energy consumption of the jet insertion device (DE-A-42 40 710, DE-A-43 04 469, WO 90/07600). Furthermore, it is known (DE-A-42 10 377) that the weft yarn is withdrawn with the aid of a pneumatic drive from a measuring feeder and presented to the jet insertion device in a buffer store at low tension.

The embodiment wherein the slip conveyor is deactivated by engaging the yarn brake is especially advantageous. The yarn brake fulfills a double function. At the end of the insertion, it gently consumes the energy of the delay of the mass of the inserted weft yarn, and simultaneously deactivates the slip conveyor, so that the latter does not damage the weft yarn. Either in the case of a downstream yarn brake, the weft yarn is relieved in the slip conveyor so that the slip increases and the slip conveyor force decreases, or in the case of a yarn brake arranged at the slip conveyor, the wrap around or the pressing against the further rotating conveyor roller is eliminated. This is simple from a constructional point of view, because the yarn brake which is almost imperative for high yarn speeds at any rate need only to be controlled.

In the embodiment where one conveyor roll is driven the weft yarn is acted upon with the slip conveyor force only on one conveyor roller which is continuously driven at surplus speed.

In the embodiment wherein the weft-yarn storage, supply and measuring device is a measuring feeder with a stop device, there is provided a standard measuring feeder whose cooperation with the slip conveyor at the end of the insertion process, which is critical for the yarn, is suppressed in a manner gentle on the weft yarn by deactivation of the slip conveyor, e.g., by the yarn brake which then becomes operative.

In the embodiment wherein the measuring feeder is oriented transverse to the insertion direction of the weft yarn into the shed, the measuring feeder can be used near the jet loom. Only a few deflection points which mechanically act on the yarn are required in the yarn path in an optimum manner because the conveyor gently deflects the weft yarn. An optimum angle of wrap can be set on the conveyor roller by alignment of the measuring feeder.

In a further embodiment, the slip conveyor force is produced on two conveyor rollers, which contributes to a desirably rapid response of the slip conveyor and adjusts the mechanical load on the weft yarn.

In the embodiment wherein at least one conveyor roller is drivingly connected to an electric motor or a turbine, the necessarily high rotational speed of the conveyor roller or of the conveyor rollers is produced in a simple and inexpensive manner. A turbine as a drive can exploit the compressed air energy existing on the jet loom at any rate.

In an especially important embodiment, the yarn brake is a deflection brake which is moved electromechanically between a passive position where the yarn is unhindered and a braking position where the yarn is deflected. With this type of yarn brake, the weft yarn is not influenced during the predominant part of the insertion process, which is advantageous at a high insertion rate and high insertion speed. When the deflection brake is adjusted at or towards the end of the insertion process, the braking effect is gradually built up. The whip effect which is critical at a high insertion rate is reduced or eliminated when the inserted weft yarn mass is being delayed and during its stretching movement. The slip conveyor force is gently decreased on the slip conveyor by the gradual engagement of the deflection brake, which is advantageous in the weft yarn which is then intercepted on the stopper.

In the embodiment wherein the deflection brake acts as a deactivator device for lifting the yarn from the conveyor roller, the deflection brake takes over an additional function. The slip conveyor force is not reduced in that the weft yarn tension is kept away from the conveyor roller, but in that the weft yarn is lifted from the conveyor roller. The deflection brake fulfills a double function because it deactivates the slip conveyor and dampens the whip effect at the end of the insertion process.

A constructionally simple and effective embodiment follows where the deflection brake includes at least one deflection element which moves transverse to the yarn. The deflection element of the deflection brake lifts the weft yarn from the conveyor roller, simultaneously performing a gentle braking of the weft yarn by deflection at the place of the conveyor roller.

An alternative embodiment follows where the yarn brake is a yarn clamp. The engageable yarn clamp becomes effective towards the end of the insertion process and downstream of the conveyor roller to reduce and annul the slip conveyor force, and to reduce the whip effect at the same time.

In another embodiment, at least one deflection device is intergrated into the deflection brake in a favorable manner so as to keep the number of points critical to friction as small as possible along the yarn path, to guide the weft yarn in a tidy manner and to contribute to the deactivation of the slip conveyor and to braking.

The alternative embodiment wherein at least one conveyor roller is movable out of engagement with the weft yarn is favorable because the slip conveyor is deactivated without the aid of the yarn brake. The controlled yarn brake may even be dispensed with.

In the embodiment wherein stationary deflection elements are provided, the stationary deflection elements are passive during operation of the slip conveyor to avoid objectionable friction points in the yarn path. The deflection points become only active brakingly when the slip conveyor has been deactivated. A controlled yarn brake is not absolutely necessary because this yarn brake is replaced at least temporarily in its function by the passive deflection elements.

BRIEF DESCRIPTION OF THE DRAWINGS

Embodiments of the subject matter of the invention are illustrated with reference to the drawing, in which.

DETAILED DESCRIPTION

Figure 1:
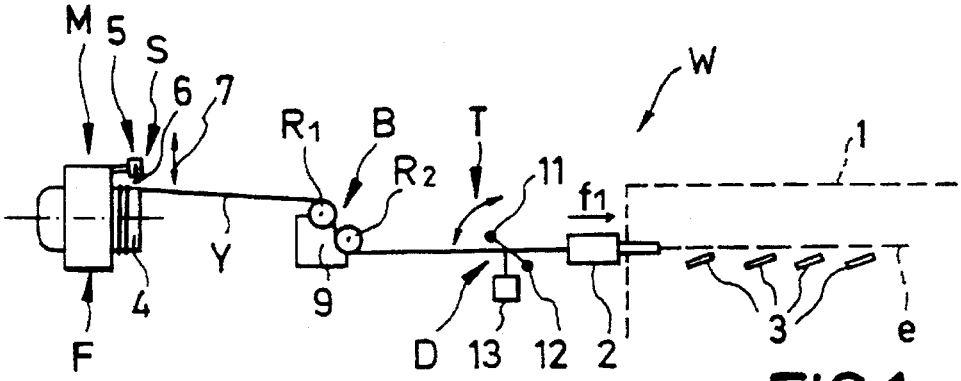
FIG. 1 is a diagrammatic lateral view of a weft-yarn insertion system.

A weft-yarn insertion system E according to FIG. 1 of a jet loom W, for example an air or water jet loom, comprises a shed 1 and a jet insertion device consisting of a main jet 2 and an auxiliary jet 3 with the aid of which a respective weft yarn is inserted in insertion direction e into shed 1. In the jet loom W, a weft-yarn storage, supply and measuring device M is provided, for example a standard measuring feeder F which comprises a drum 4 for forming a yarn supply consisting of windings for the weft yarn Y and a weft-yarn stopping and releasing device S which is controllable in response to a weaving cycle. In the measuring feeder F, the stopping and releasing device consists of a stopping device 5 held stationary outside of drum 4 on the withdrawal end thereof and comprising an engageable and disengageable stopper 6 which in the engaged state fixes weft yarn Y against a withdrawal movement and permits overhead withdrawal of the weft yarn Y in the disengaged state. The direction of movement of stopper 6 is outlined with a double-headed arrow 7.

A slip conveyor B and, downstream thereof, a yarn brake T which can be engaged in a controlled manner are provided between the measuring feeder F and the jet insertion device 2, 3 in the yarn path of the weft yarn Y. Stationary yarn guiding devices (not shown) may optionally be provided upstream and downstream of the slip conveyor B.

According to FIG. 1 the slip conveyor B comprises two adjacent conveyor rollers R1, R2 at which the weft yarn Y is respectively deflected at a predetermined angle of wrap. Both conveyor rollers R1, R2 are continuously driven in the direction of insertion, namely at a circumferential speed higher than the maximum yarn insertion speed.

The conveyor rollers R1, R2 are in driving communication with drive means 9 which is an electric motor or a turbine.

The controlled yarn brake T according to FIG. 1 is a so-called deflection brake D comprising a plurality of deflection elements 11, 12 and a drive 13 operable in response to the weaving cycle. The deflection brake D is movable between a passive position (shown) in which the weft yarn Y passes in unhindered fashion, and a braking position (not shown) in which the brake deflection elements 11, 12 deflect and brake the weft yarn Y in Z-shaped configuration.

In the operative position shown in FIG. 1, stopper 6 is being disengaged; the jet insertion device 2, 3 pulls with a force (yarn tension f1) on the weft yarn. The weft yarn is thereby pressed with its yarn tension against the conveyor rollers R1, R2 and is withdrawn with a slip from drum 4, the extent of the slip or the slip conveyor force f2 depending, inter alia, on yarn tension f1. Towards or at the end of the insertion process, the deflection brake D is moved into the braking position, and the stopper 6 is engaged at the same time or with a lag. The resultant braking effect reduces the whip effect when the already inserted weft yarn Y is being delayed, and reduces the yarn tension acting in the region of the slip conveyor B to such an extent that the slip conveyor force f1 decreases and stopper 6 stops the weft yarn without any difficulty. The slip conveyor B thereby is deactivated by the brake D. The deflection brake D is then moved into the passive position, so that a weft-yarn tension will become operative again up to the slip conveyor B. As soon as the stopper 6 has been disengaged for the next insertion operation, the slip conveyor B withdraws the weft yarn Y again and assists the jet insertion device 2, 3.

Figure 2:
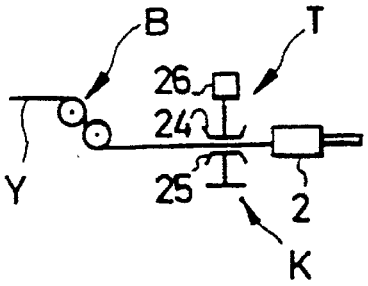
FIG. 2 shows a variant of FIG. 1.

In the embodiment according to FIG. 2, the controllable yarn brake T which is arranged downstream of the slip conveyor B is a controlled yarn clamp K with brake clamping elements 24, 25 and a drive 26. The effect is similar to the one in the first embodiment.

Figure 3:
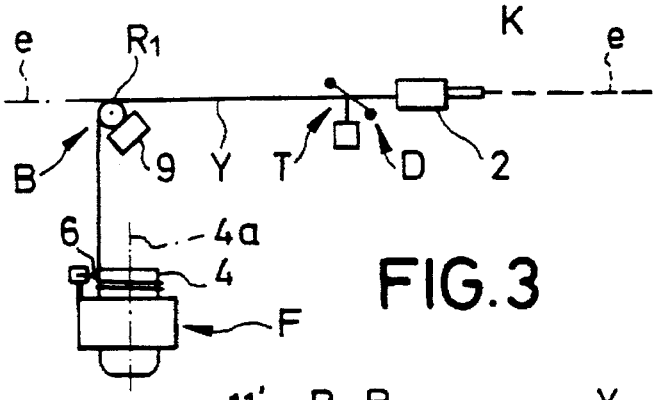
FIG. 3 shows a variant with a different yarn geometry.

In the variant according to FIG. 3, the slip conveyor B only comprises one driven conveyor roller R around which the weft yarn Y is deflected. The measuring feeder F is oriented with an axis 4*a* of its drum 4 approximately in a direction transverse to the insertion direction e, with the conveyor roller of the slip conveyor B deflecting the weft yarn. Either a deflection brake D or a controlled yarn clamp (not shown) is provided as the controlled yarn brake T. There is shown an angle of wrap of approximately 90°. However, a greater or smaller angle of wrap can also be set. At least one stationary yarn guiding device is optionally provided in the yarn path (not shown).

Figure 4A:
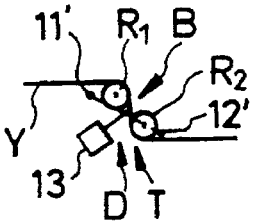
FIGS. 4A, 4B show another variant in two operative positions.
Figure 4B:
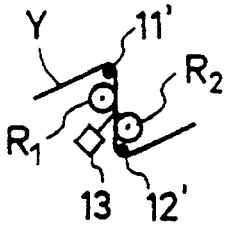
Figure 6A:
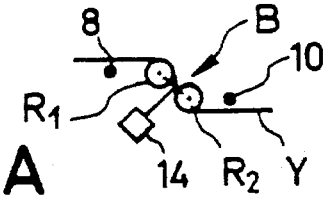
FIGS. 6A, 6B show another variant in two operative positions.

In the variant according to FIGS. 4A and 4B, the controlled yarn brake T is arranged at the slip conveyor B or integrated thereinto and formed as the deflection brake D. The slip conveyor B comprises the two conveyor rollers R1, R2. The deflection elements 11', 12' of the deflection brake D are arranged such that in the passive position of the deflection brake D, which is shown in FIG. 6A, the weft yarn Y surrounds the conveyor rollers R1, R2 in unhindered fashion. In the braking position according to FIG. 6B, the deflection elements 11', 12' are adjusted such that the weft yarn Y is at least predominantly lifted from the conveyor rollers R1, R2 and braked by deflection at the same time.

Figure 5A:
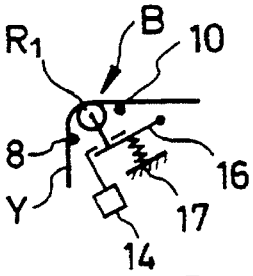
FIGS. 5A, 5B show another variant in two operative positions.
Figure 5B:
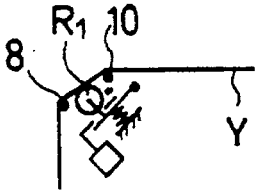

In the variant according to FIGS. 5A, 5B, the weft yarn Y is deflected by approximately 90° around a conveyor roller R1 in a manner similar to FIG. 3. The conveyor roller R1 can be deactivated with the actuator 14, i.e., it can be moved or pivoted away from the weft yarn, and to this end it is supported, for example, on a lever 16 which can be pivoted against the force of a spring 17. FIG. 5B shows the deactivated position of the conveyor roller R1.

Figure 6B:
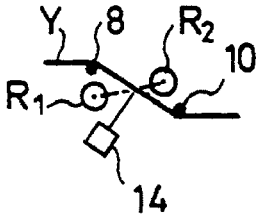

In the variant of FIGS. 6A, 6B, two conveyor rollers R1, R2 are provided as in FIGS. 1 and 2. The two conveyor rollers R1, R2 can be moved by means of the actuator 14 into the deactivated position shown in FIG. 5B, in which they no longer act on the weft yarn Y or only act thereon to a negligible degree, and the weft yarn Y is deflected on stationary deflection elements 8, 10.

In the embodiments of FIGS. 5A, 5B, 6A, 6B, a controlled yarn brake may optionally be dispensed with downstream of the slip conveyor B, since in the deactivated position of the slip conveyor B there is a deflection which has a braking effect and which can reduce the whip effect. If a controlled yarn brake is provided downstream of the slip conveyor B, such a brake only serves to further reduce the whip effect and to brake the weft yarn gently when the slip conveyor B has been deactivated by means of actuator 14.

We claim:

1. An insertion system for a weft yarn of a jet loom, comprising:

a weft-yarn storage, supply and measuring device for storing the weft yarn thereon and including a weft-yarn stopping and releasing device which has control means for controlling said weft yarn stopping and releasing device in response to a weaving cycle, a jet insertion device disposed downstream of said weft-yarn storage, supply and measuring device which withdraws said weft yarn from said weft-yarn storage, supply and measuring device with a withdrawal tension and transports said weft yarn in an insertion direction to a shed, a mechanical weft-yarn slip conveyor arranged in a yarn path from said weft-yarn stopping and releasing device to said jet insertion device, said slip conveyor comprising at least one conveyor roller rotating in the insertion direction of said weft yarn at a faster circumferential speed than a maximum weft-yarn insertion speed for conveying said weft-yarn, said insertion system including deactivating means for activating and deactivating said slip conveyor to respectively increase and decrease a slip conveyor force acting on said weft yarn while said conveyor roller is rotating during an insertion process, wherein, with said slip conveyor activated, said weft yarn surrounding at least a partial region of the circumferential surface of the roller and being acted upon by said circumferential surface with said slip conveyor force determined by said withdrawal tension, and a yarn brake arranged in the yarn path at said slip conveyor or downstream of said slip conveyor which is engagable with and disengagable from said weft-yarn while said slip conveyor is activated and deactivated respectively in dependence upon the weaving cycle.

2. The insertion system according to claim 1, wherein said yarn brake is engaged and disengaged by said deactivating means, said deactivating means further causing said slip conveyor to be deactivated upon causing said yarn brake to be engaged with said weft yarn.

3. The insertion system according to claim 1, wherein said at least one conveyor roller of said slip conveyor is continuously rotated by drive means.

4. The insertion system according to claim 1, wherein said weft-yarn storage, supply and measuring device is formed as a measuring feeder having a drum for overhead withdrawal of the weft yarn stored on said drum and having a stopper arranged on a withdrawal end of said drum, said stopper including engagement means for engaging said stopper for stopping the withdrawn yarn and disengaging said Stopper to permit withdrawal of said yarn, said yarn brake being adapted to be engageable at the end of said insertion process and before the stopping of the withdrawn weft yarn by said stopper.

5. The insertion system according to claim 4, wherein said measuring feeder is arranged with an orientation of said drum in a direction transverse to the insertion direction of said weft yarn into said shed, said weft yarn being deflected between said stopper and said jet insertion device around said conveyor roller at an angle of wrap of about 90°.

6. The insertion system according to claim 1, wherein said slip conveyor comprises two adjacent and continuously driven conveyor rollers.

7. The insertion system according to claim 1, wherein said conveyor roller is in driving communication with an electric motor or a turbine.

8. The insertion system according to claim 1, wherein said yarn brake arranged downstream of said slip conveyor is a deflection brake which is movable by said deactivation means between a passive position permitting the unhindered passage of said weft yarn and a braking position deflecting said weft yarn.

9. The insertion system according to claim 1, wherein said yarn brake is a deflection brake which is movable by said deactivating means between a passive position permitting the unhindered passage of said weft yarn and a braking position deflecting said weft yarn, said yarn brake being adapted additionally as a deactivator device by connection to said deactivating means for deactivating said slip conveyor by lifting said weft yarn from said at least one conveyor.

10. The insertion system according to claim 9, wherein said deflection brake comprises at least one deflection element which is movable in a direction transverse to said weft yarn by said deactivating means, and said weft yarn is deflected in the passive position of said yarn brake exclusively on said at least one conveyor roller, whereas in the active braking position said yarn is lifted at least predominantly from said at least one conveyor roller by said deflection element.

11. The insertion system according to claim 10 wherein said at least one deflection element is adapted to guide said yarn.

12. The insertion system according to claim 1, wherein said yarn brake is arranged downstream of said slip conveyor and is a controllable yarn clamp which is driven by said deactivating means.

13. The insertion system according to claim 1, wherein said at least one conveyor roller is arranged to be movable by said deactivating means relative to said weft yarn from and into said yarn path for respectively deactivating and activating said slip conveyor, said deactivating means comprising an actuator which is provided for moving said at least one conveyor roller in dependence upon said weaving cycle.

14. The insertion system according to claim 1, wherein said at least one conveyor roller is removable from said yarn path by said deactivating means for deactivating said slip conveyor, said yarn brake including stationary deflection elements associated with said at least one conveyor roller which are disposed in said yarn path so that said weft yarn is brakingly deflected in the deactivated state of said slip conveyor.

15. The insertion system according to claim 1, wherein said yarn brake includes at least one brake element and said deactivating means comprise drive means operatively connected to said brake element for moving said brake element into engagement with said weft-yarn to reduce said withdrawal tension and out of engagement with said weft-yarn for increasing said withdrawal tension, said slip conveyor force being increased and decreased by respective increases and decreases in said withdrawal tension to respectively activate and deactivate said slip conveyor.

16. The insertion system according to claim 1, wherein said yarn brake includes at least one stationary brake element and said deactivating means comprise actuator means operatively connected to said at least one conveyor roller for moving said conveyor roller into engagement with said weft-yarn to increase said slip conveyor force and out of engagement with said weft-yarn to decrease said slip conveyor force, said brake element being engaged with said weft yarn when said slip conveyor is deactivated to brake said yarn.

17. An insertion system for a weft yarn of a jet loom comprising:

a yarn feeder having a storage drum on which the weft-yarn is stored, said yarn feeder having a weft-yarn stop for stopping and releasing said weft yarn being withdrawn from said storage drum in response to a weaving cycle, a jet insertion device disposed downstream of said yarn feeder for withdrawing said weft yarn from said yarn feeder with a withdrawal tension and transporting said weft yarn to a shed during a weaving cycle, said weft yarn extending along a yarn path from said yarn feeder to said jet insertion device and being transported in an insertion direction to said shed;

a mechanical weft-yarn slip conveyor arranged along the yarn path which includes at least one conveyor roller and drive means for rotating said conveyor roller in the insertion direction of said weft yarn at a circumferential speed greater than a maximum weft-yarn insertion speed at which said weft yarn is transported, said weft yarn being engagable with at least a partial region of a circumferential surface of the roller which acts upon said weft yarn to apply a slip conveyor force which varies in response to said withdrawal tension;

a yarn brake disposed in said yarn path which includes at least one brake element, said yarn brake being engagable and disengagable from said weft yarn to respectively decrease and increase said withdrawal tension; and actuation means for moving one of said brake element and said conveyor roller into and out of engagement with said weft yarn to vary said slip conveyor force, said slip conveyor force being increased as said yarn brake is disengaged and being decreased as said yarn brake is engaged.

18. The insertion system according to claim 17, wherein said actuation means comprise drive means for moving said conveyor roller away from said weft yarn to a deactivated position and toward said weft yarn to an activated position, said weft yarn being engaged with said yarn brake when said conveyor roller is in said deactivated position and being disengaged from said yarn brake when said conveyor roller is in said activated position.

19. The insertion system according to claim 17, wherein said actuation means comprise brake drive means for moving said brake element into engagement with said weft yarn to brake said weft yarn and reduce said withdrawal tension, said slip conveyor force applied by said conveyor roller being reduced as said withdrawal tension is reduced to deactivate said slip conveyor.

20. The insertion system according to claim 19, wherein said weft is lifted yarn off of said conveyor roller as said brake element is engaged.

* * * * *

UNITED STATES PATENT AND TRADEMARK OFFICE

CERTIFICATE OF CORRECTION

PATENT NO. : 5 660 213

DATED : August 26, 1997

INVENTOR(S) : Lars Helge Gottfrid THOLANDER et al

It is certified that error appears in the above-indentified patent and that said Letters Patent is hereby corrected as shown below:

Column 6, line 66; change "Stopper" to ---stopper---.

Column 7, line 28; after "conveyor" insert ---roller at said slip conveyor---.

Signed and Sealed this

Second Day of June, 1998

*Attest:*

*Attesting Officer*

BRUCE LEHMAN

*Commissioner of Patents and Trademarks*